US005361935A

United States Patent [19]

Saguciо

[11] Patent Number: 5,361,935

[45] Date of Patent: Nov. 8, 1994

[54] SPILL-RESISTANT CUP FOR SOFT DRINK

[76] Inventor: Esteban N. Saguciо, 11330 Two Wells, San Antonio, Tex. 78245-2254

[21] Appl. No.: 182,459

[22] Filed: Jan. 18, 1994

[51] Int. Cl.[5] ..... A47G 19/22

[52] U.S. Cl. ..... 220/709; 220/705; 220/720; 215/229

[58] Field of Search ..... 229/103.1; 220/705, 220/709, 719, 720, 721; 215/1 A, 229

[56] References Cited

U.S. PATENT DOCUMENTS

| | | | |
|---|---|---|---|
| 2,948,453 | 8/1960 | Drown | 220/719 X |
| 4,085,861 | 4/1978 | Ruff | 220/713 |
| 4,151,927 | 5/1979 | Cvacho et al. | 220/606 |
| 4,441,640 | 4/1984 | Lottick | 215/1 A X |
| 4,494,668 | 1/1985 | Lottick | 220/709 |
| 4,577,775 | 3/1986 | Kresin | 220/606 X |
| 4,756,440 | 7/1988 | Gartner | 220/711 |
| 4,928,876 | 5/1990 | Marshall | 220/705 X |
| 4,938,375 | 7/1990 | Fantacone | 220/709 |

*Primary Examiner*—Allan N. Shoap
*Assistant Examiner*—Jes F. Pascua

[57] ABSTRACT

A drinking cup for soft drinks and other beverages will resist spill of its content when it gets toppled over. The bottom end of a drinking straw is inserted into a built-in capping cavity at the bottom of the cup to keep the drink from flowing out through the straw, and a capping lid is disposed with corrugations, in a concentric pattern, to absorb the sudden force of the toppled over drink. Thus, there's better chance the lid will not break open and spill the cup's content.

3 Claims, 2 Drawing Sheets

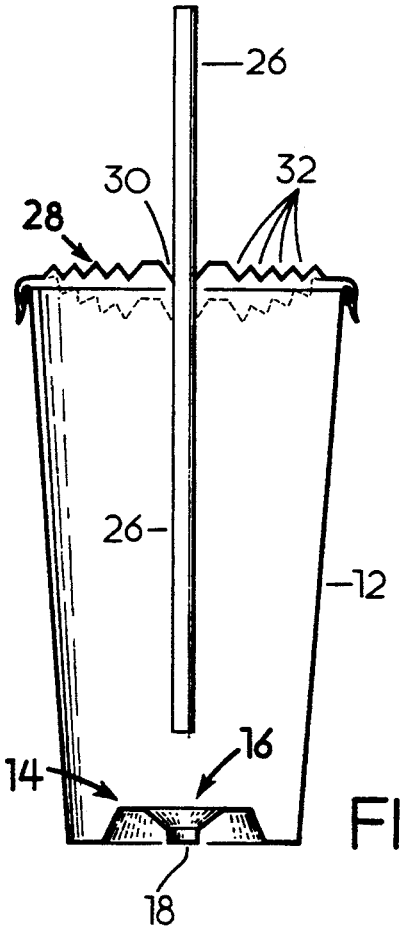
FIG. 1
FIG. 2
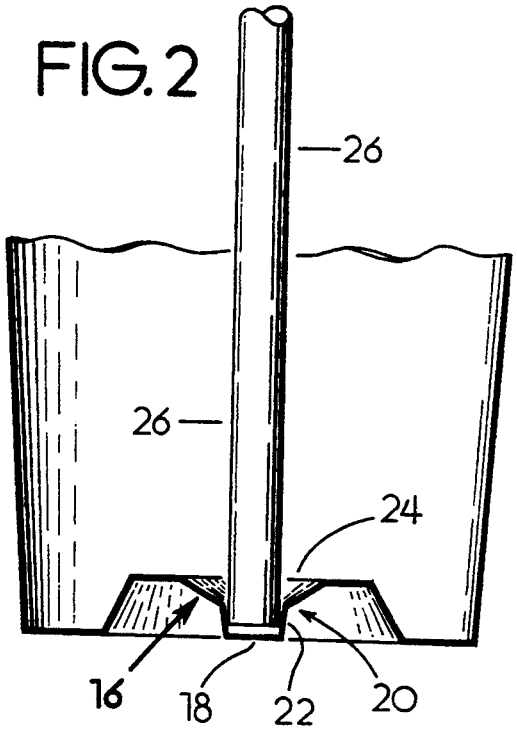
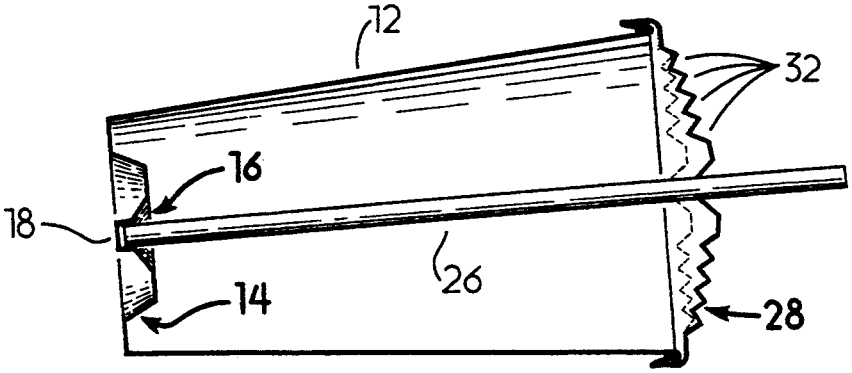
FIG. 3

SPILL-RESISTANT CUP FOR SOFT DRINK

BACKGROUND

The present invention relates generally to drinking containers and pertains particularly to plastic, paper and styrofoam cups commonly used with soft drinks and other beverages. It is designed to resist spill of its content when it gets toppled over.

Lots of customers of fast food and refreshment parlors buy take-out food and/or drinks when travelling, going to recreation and amusement parks, beaches and other places. For many, it is a habit to consume their drinks periodically and taking several extended interruptions between drinking periods especially with the larger size drinks. Sometimes during these interruptions, a topple over happens and cause a spill. This incident happen specially frequently in a moving vehicle, windy outdoor and in a crowd.

Prior art cup of the kind lack positive measures for resisting spill of its content when it gets toppled. Liquid would egress through the drinking straw itself and through an oversize pre-cut opening on the lid where the straw is inserted into. And in many cases the lid would break open due to sudden force of the liquid inside the cup.

SUMMARY OF THE INVENTION

Accordingly, it is the object of the present invention to provide a cup which will resist spill during topple or overturn.

Another object is to keep the drinker from continuously holding or always watching his cup during drinking interruptions.

In a preferred embodiment, the new cup includes a built-in cavity at the bottom to cap the lower end of the drinking straw when the latter is inserted into the cavity. The cup also include a lid that flexes easily toward the inside of the cup in response to a vacuum being created, or toward the outside in response to a surge of liquid in the event of an overturn.

These and other objects and advantages will become apparent from the foregoing and ongoing specifications, drawings and appended claims.

BRIEF DESCRIPTION OF THE DRAWINGS

FIG. 1 is a cross-sectional view of a new plastic cup with a lid and a drinking straw.

FIG. 2 shows an enlarged bottom portion of the cup shown in FIG. 1 with the lower end of the straw inserted into a built-in capping cavity.

FIG. 3 shows the cup lying on its side or a position of a fallen cup.

DESCRIPTION OF THE PREFERRED EMBODIMENT

Figure 4:
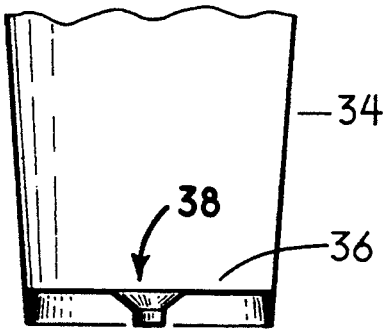
FIG. 4 is a fragment of a cup with waxed paper side wall and with plastic bottom wall including the cavity portion.

Referring now to the drawings for better understanding, a spill-resistant cup for soft drinks and other beverages constructed in accordance with the teachings of the present invention is illustrated.

The new cup generally has the outside features of the commonly used plastic, waxed paper and styrofoam cups. The new cup however, include a cavity at the bottom adapted to cap the lower end of the drinking straw. FIG. 1 shows an entirely plastic cup, defined by a frusto-conical side wall 12 extending in an upwardly diverging direction and a circular bottom wall 14 sealing off the bottom end of said frusto-conical side wall.

In FIG. 2, the bottom wall 14 can be seen better as having a small cavity portion 16 with a closed lower end 18 and an annular side wall 20. The lower portion 22 of the side wall diverge very slightly upwardly from the closed lower end 18. Whereas, the upper portion 24 is widely flared, as shown, in order to provide a guide means when sinking the lower end of a tubular drinking straw 26 into the cavity.

The diameter of the straw 26 and that of the lower portion 22 of the annular side wall 20 are compatibly sized such that when the straw is pushed downwardly into the cavity with the right pressure, the cavity imparts a good grip onto the bottom end of the straw, as shown in FIG. 2. This in effect, caps the straw and thus blocking liquid flow through the straw.

Figure 6:
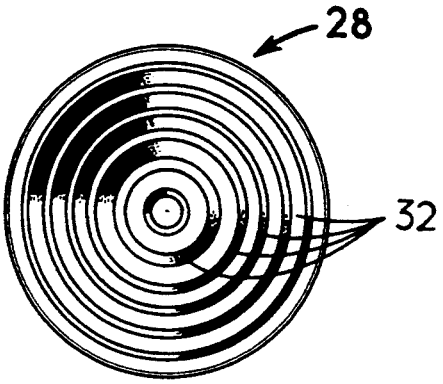
FIG. 6 is a top view-of a concentrically corrugated plastic lid adapted to cap the top end of the new cup.
Figure 7:
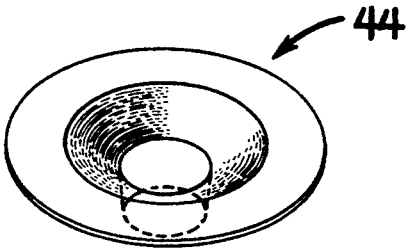
FIG. 7 is a perspective of the plastic cavity portion of the cup shown in FIG. 5, attachable with glue or other suitable means.

A detachable lid 28 (see FIGS. 1, 3 and 6) used to cap the top end of the new cup includes a round hole 30 having a diameter such that when the straw is inserted through, a light grip is imparted onto the straw. This round hole 30 may be made outright when the lid was manufactured or may be a scored knock-out portion ready to be poked open when needed. The lid also include a plurality of corrugations 32 arranged in a concentric pattern surrounding the hole. These corrugations provide extra flexibility for the lid to flex inwardly, as shown by broken lines in FIG. 1, when one drinks with a straw and a partial vacuum is created, or to flex outwardly, as shown by the solid line in FIG. 3, when the cup is toppled over and a surge of liquid is present. Thus, the shock is absorbed and that the lid has better chance not to break open.

Figure 5:
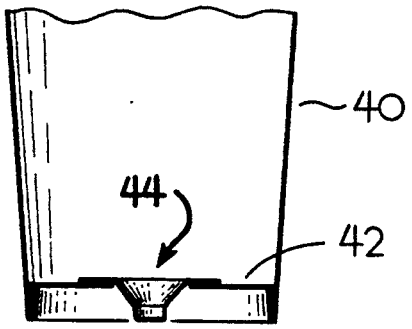
FIG. 5 is a fragment of a cup with waxed paper side and bottom walls and with a cavity portion made of plastic.

The new cup can be manufactured entirely of plastic or styrofoam materials or a combination of waxed paper and plastic. In FIG. 1 for example, the cup has plastic side 12 and bottom 14 walls including the cavity portion 16; the cup shown in FIG. 4 has waxed paper side wall 34 and plastic bottom wall 36 including the cavity portion 38; while in FIG. 5 the cup has waxed paper side 40 and bottom 42 walls and plastic cavity portion 44. The latter cavity portion 44 is fixedly attached to the bottom wall 42 with glue or other suitable means. The straw used with the new cup when manufactured, include visually distinct codes or color stripes along the length of the straw (not shown) which is different from the colors presently used. This makes it easier for the vendor or customer to identify the compatible straw needed during purchase of a take-out soft drink using the new cup.

In the use of the spill-resistant cup, with the lid already attached as shown in FIG. 1, a compatible straw is inserted into a ready-made hole on the lid (or through a scored knock out portion) and pushed down until the bottom of the straw gets to a convenient distance of about one-inch from the bottom of the cup. With the straw in place, the soft drink is sucked into the mouth the conventional way. If a rather large volume of drink is sucked in and a partial vacuum is created inside the cup, the lid flexes down as shown by the dotted lines in FIG. 1. On flexing, it will either drag down the straw with it or slip down about the straw, depending how tight is the grip of the hole or the grip of the drinker's lips. When sucking is over and the drinker let-go of the straw, relieving air rushes into the cup through the straw and the lid resume its original form, as shown by the solid line in FIG. 1.

When there's intent to temporarily stop drinking for an extended period, the straw is pushed down so that the bottom end sinks into the cavity at the bottom of the cup, as shown in FIG. 2. This in effect cap the straw and prevent any liquid flow from the cup even at a toppled position, as shown in FIG. 3. During a topple over where there's sudden liquid force tending to push the lid outward, the lid will flex outward as shown by the solid line in FIG. 3 and thus there's a good chance the lid will remain intact and no spill will occur.

When drinking is again resumed, the straw is raised so that the bottom end is off the capping cavity at the bottom of the cup.

While the instant invention has been shown and described by means of preferred embodiments, it will be understood that numerous changes and modifications may be made therein without departing from the spirit and scope of the invention as defined in the appended claims:

I claim:

1. A combination of a cup, a tubular drinking straw and a plastic lid for resisting spilling of beverages comprising:

(a) a cup having an upwardly diverging frusto-conical side wall, a top end, a bottom end and a circular bottom wall sealing off the bottom end; said bottom wall further comprising a cavity portion for receiving an end of a tubular drinking straw, said cavity portion having a closed lower end and an annular side wall diverging upwardly from said closed lower end;

(b) a tubular drinking straw having an end disposed within said cup for orally drawing beverages from the cup; and (c) a plastic lid detachably capping the top end of said cup, said lid having a round opening for receiving said tubular drinking straw, said lid includes a plurality of concentrically disposed corrugations for providing inward flexibility of the lid when a partial vacuum is present within the cup and outward flexibility of the lid when the cup is toppled over and a surge of beverage from within the cup is present;

(d) wherein the closed end of said cavity portion is of a selected size such that when the end of the drinking straw is inserted into the closed end, the closed end grips and caps the end of the drinking straw thereby preventing any flowing of beverage through the end of the drinking straw.

2. The combination of claim 1 wherein the annular side wall of said cavity portion is flared widely to provide a means for guiding the end of the drinking straw into the closed end.

3. The combination of claim 1 wherein the round opening of said plastic lid is of a selected size to slidably grip said tubular drinking straw.

* * * * *